US006185766B1

(12) United States Patent
Farrugia

(10) Patent No.: US 6,185,766 B1
(45) Date of Patent: Feb. 13, 2001

(54) BED COVERING ANCHOR SYSTEM

(76) Inventor: Dorothy J. Farrugia, 1687 Chateau, Anaheim, CA (US) 92802

( * ) Notice: Under 35 U.S.C. 154(b), the term of this patent shall be extended for 0 days.

(21) Appl. No.: 09/404,699

(22) Filed: Sep. 24, 1999

(51) Int. Cl.[7] ..... A47G 9/04
(52) U.S. Cl. ..... 5/498; 5/494; 24/72.5
(58) Field of Search ..... 5/494, 496, 498; 24/72.5

(56) References Cited

U.S. PATENT DOCUMENTS

| | | | | |
|---|---|---|---|---|
| 2,284,778 | * | 6/1942 | Treiber | 5/498 |
| 3,092,848 | * | 6/1963 | Gronvold | 24/72.5 |
| 4,688,282 | | 8/1987 | Jeffries | 5/413 |
| 4,829,617 | | 5/1989 | Dameron | 5/508 |
| 4,891,856 | * | 1/1990 | Thornhill | 5/498 |
| 4,899,407 | | 2/1990 | McCue | 5/508 |
| 5,072,470 | * | 12/1991 | Lysiak | 5/498 X |
| 5,179,743 | * | 1/1993 | Lanman | 5/498 |
| 5,651,153 | | 7/1997 | Goodrich | 5/498 |

* cited by examiner

*Primary Examiner*—Michael F. Trettel
(74) *Attorney, Agent, or Firm*—Dennis W. Beech

(57) ABSTRACT

The bed covering anchor system in the preferred configuration has a pair of adjustable length crossing support straps to allow attachment to the area of the corners of a variety of sizes of bed covering placed on bed mattresses. Elastic straps are engaged at the ends of the crossing straps and have a grasping device at one or both ends of each elastic strap to grasp the covering and provide a retracting force to keep the covering taut on the mattress. One or more lateral support straps may also be attached to the cover to keep the longitudinal edges of the covering taut at the points of attachment.

2 Claims, 2 Drawing Sheets

BED COVERING ANCHOR SYSTEM

BACKGROUND OF THE INVENTION

1. Field of the Invention

This invention relates to devices and systems used to retain sheets and bed covers in proper position on a bed mattress. The new system uses adjustable length straps and elastic straps with grasping members or clamps to accommodate a variety of sizes and shapes of mattresses and many variations in sheet and bed cover sizes.

2. Description of Related Art

There are currently a variety of devices and apparatus used to anchor bed sheets and covers in proper position on a mattress. Much past work has been done for water beds due to the problem that one can not easily tuck a sheet or bed cover under the water bed mattress. Most of the devices and systems involve the use of hook and loop material attached to the mattress support such as frame, box springs and water bed enclosure and compatibly located hook and loop material attached to the sheet, cover or other lining.

Some of these systems also use short straps to extend from a point of attachment at the mattress support element to the corresponding sheet or cover hook and loop device. Snaps on the sheet or covers have also been used as well as garter like straps with clips and hooks or posts. In addition, sheets and covers have been fitted with snaps and zippers for retaining such to mattress support elements and bed skirts.

The present invention provides an adjustable, essentially self contained system for anchoring bed sheets, bed covers and the like. By use of adjustable length straps with attached elastic straps and clasps the invention can accommodate a variety of mattress sizes as well as covering sizes. The system does not require attachment by sewing or other means of any elements to the mattress, mattress support structure or the covering as in the existing art. The invention uses a grasping means to hold the covering and straps for maintaining retractive force for the grasping means to retain coverings on the mattress.

SUMMARY OF THE INVENTION

One object of the present invention is retention of a bed sheet, bed cover or the like on a mattress. Another object is retention of such coverings without the need to attach elements to the mattress support structure such as frame, box springs and the like. A further object is accommodation for a variety of mattress and covering sizes using an adjustable means for support of a grasping member.

In accordance with the description presented herein, other objectives of this invention will become apparent when the description and drawings are reviewed.

DESCRIPTION OF THE PREFERRED EMBODIMENT

Figure 1:
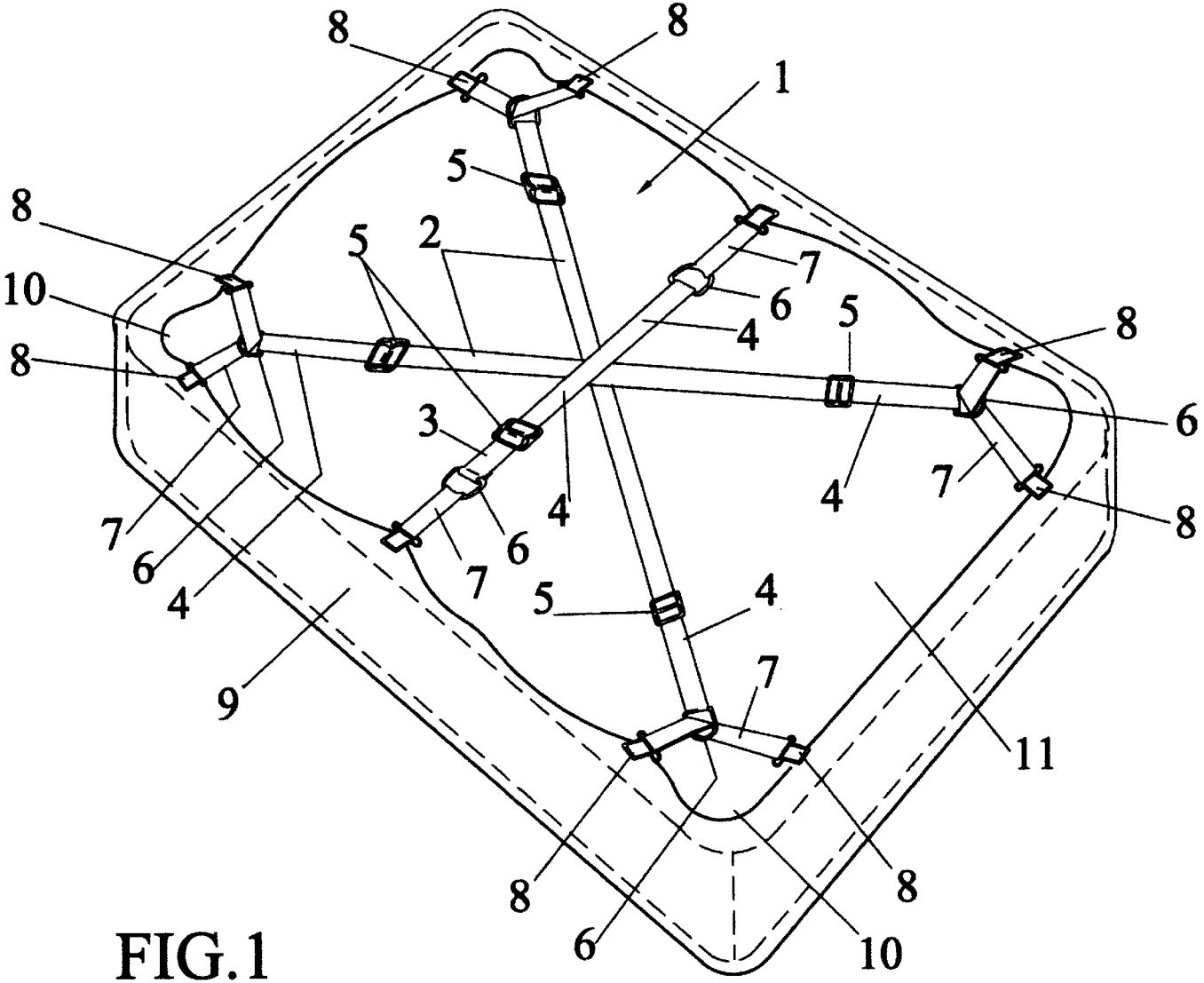
FIG. 1 illustrates a perspective view of the anchor system, attached to a mattress covering and being disposed on the bottom of the mattress.

The bed covering anchor system has one or more support straps which are adjustable in length and at each end have attached an elastic strap. The elastic strap has one or more grasping members or clasps for grasping a mattress covering. In the basic configuration there are two support straps serving as crossing members to allow for grasping of bed coverings approximately at the four corners. Additional support straps as for example lateral straps may be used to further grasp the covering across the longitudinal length or equivalently support straps for grasping along the covering lateral dimension.

Referring to FIGS. 1 through 5, the anchor system (1) in the preferred embodiment has cross member support straps (2) and a lateral member support strap (3). Each of these support straps (2,3) may be fabricated as identical elements with provision for adjustment of length by overlapping element (4) and adjustment ring (5). The support straps (2,3) have rings (6) at each end.

Figure 3:
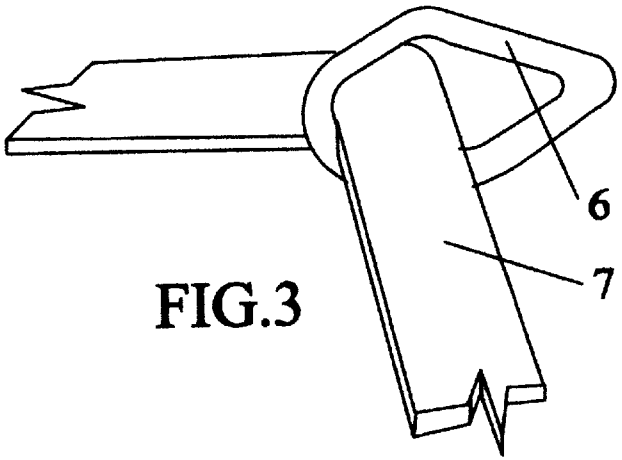
FIG. 3 illustrates an example grasping member which is a double action locking type.
Figure 5:
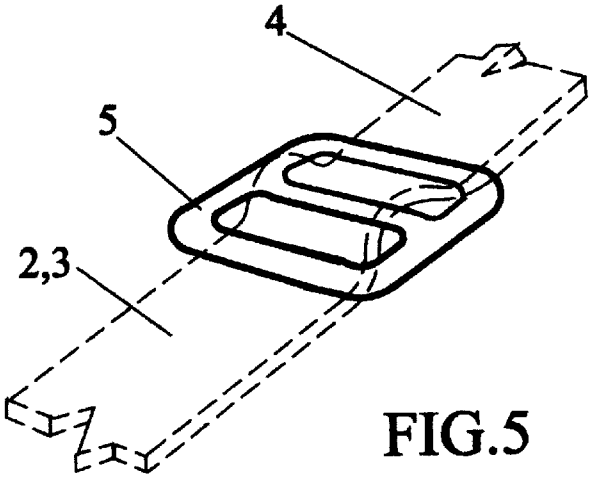
FIG. 5 illustrates an adjustable ring for the support strap.

For cross member attachment, an elastic strap (7) is slidably engaged with each of the rings (6) to allow translatable movement along the elastic strap (7) length. The elastic straps (7) have grasping members (8), as for example, spring biased type, double action locking type, as illustrated in FIG. 3, and the like, attached at each end. To attach the assembly to the covering (9) at the corners (10), the support straps (2) are adjustable to a suitable length for the specific mattress (11) and covering (9). The elastic straps (7) with grasping members (8) engaged with the covering (9) provide a retracting force to keep the covering (9) taut on the mattress (11).

The lateral member support strap (3) may be of the same form as cross member support straps (2) or, as shown, it may have a single grasping member (8) attached at one end of each elastic strap (7) with the opposite end of the elastic straps (7) being fixedly attached to ring (6).

Figure 2:
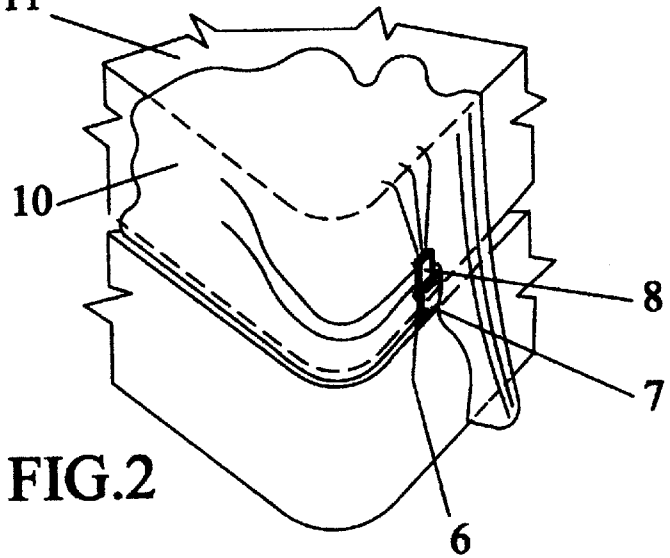
FIG. 2 illustrates a partial perspective view of a mattress with covering clasped adjacent to a mattress corner and a box spring support structure.
Figure 4:
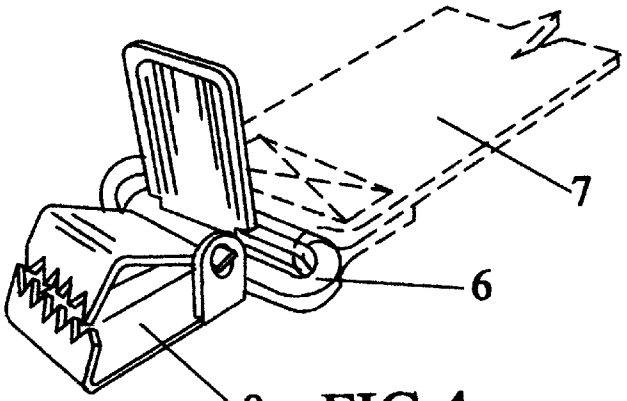
FIG. 4 illustrates the elastic strap slidably engaged with a ring for attachment to a support strap.

As can be seen from the disclosure, flexibility in anchoring the bed or mattress covering (9) such as bed sheet, bed cover and the like is facilitated as no special fasteners, attachment or other elements are required to be attached or applied to the bed elements or the coverings. The support straps (2,3) general remain in place once positioned between a mattress (11) and a bed support element such as box springs. Only the elastic straps (7) need to be reached near the edges of the mattress (11) each time it is desired to attach a covering (9). As illustrated in FIG. 2, covering (9) corners may be grasped and yet allow covering fold over for an ornamental appearance. Obviously more than one lateral member anchor may be used.

While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A bed covering anchor system comprising:

a cross member support strap element being of generally a cross shape and having four ends; and an elastic band slidably engaged at each cross member support strap element end by a means for engagement with each elastic band having a grasping member on both ends attached for grasping a bed covering at the approximate corners when placed on a mattress.

2. The bed covering anchor system as in claim 1 wherein the means for engagement is a ring.

* * * * *